US006682366B2

(12) United States Patent
Tanaka

(10) Patent No.: US 6,682,366 B2
(45) Date of Patent: Jan. 27, 2004

(54) CONNECTOR

(75) Inventor: Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 89 days.

(21) Appl. No.: 09/898,187

(22) Filed: Jul. 3, 2001

(65) Prior Publication Data

US 2002/0072277 A1 Jun. 13, 2002

(30) Foreign Application Priority Data

Jul. 12, 2000 (JP) ..... 2000-211769

(51) Int. Cl.[7] ..... H01R 13/40
(52) U.S. Cl. ..... 439/595; 439/752
(58) Field of Search ..... 439/595, 752, 439/752.5

(56) References Cited

U.S. PATENT DOCUMENTS 5,807,130 A 9/1998 Miller et al.
5,820,411 A 10/1998 Okabe
6,159,047 A 12/2000 Tanaka

FOREIGN PATENT DOCUMENTS

JP 61-71972 5/1986

*Primary Examiner*—Khiem Nguyen
(74) *Attorney, Agent, or Firm*—Gerald E. Hespos; Anthony J. Casella

(57) ABSTRACT

A housing (10) is formed with resin locks (15) that cantilever forward along inner walls of cavities (13) into which terminal fittings (30) can be inserted, and a mold-removal space (17) extends from the resin locks (15) to the front end surface of the housing (10). A loose movement restricting member (20) is fit into the mold-removal space (17) and contacts the terminal fittings (30) to restrict loose movement of the terminal fittings (30). The width of the mold-removal space (17) can be set freely because a part separate from the housing (10) is fitted into the mold-removal space (17) for restricting the loose movements of the terminal fittings (30). Therefore, the resin locks (15) can be wide and sufficiently strong.

12 Claims, 6 Drawing Sheets

CONNECTOR

BACKGROUND OF THE INVENTION

1. Field of the Invention

The present invention relates to a connector.

2. Description of the Related Art

Japanese Utility Model Publication No. 61-71972 discloses a connector that has a connector housing formed from a synthetic resin. The housing includes a plurality of cavities each of which is defined by a plurality of inner walls. One inner wall of each cavity is formed with a resin lock that projects into the respective cavity. The connector further includes a corresponding plurality of terminal fittings inserted into the respective cavities. The resin locks are configured to lock the terminal fittings in the respective cavities and to restrict the loose movements of the terminal fittings in vertical and transverse directions normal to an insertion direction of the terminal fittings.

Formation of the resin locks requires a portion of the inner wall before the resin lock to be cut away. Additionally, the resin lock requires a mold-removal space that extends to the front end surface of the housing. The mold-removal space must be as wide as the resin lock. For example, the resin lock and the mold-removal space could be formed over the entire width of the inner wall for each cavity. However the front part of the terminal fitting could move loosely into the mold-removal space. Thus, a loose movement of the terminal fitting in either vertical or transverse direction cannot be restricted in front of the resin lock.

Conventional connectors typically restrict loose movement by having a resin lock and a mold-removal space that are narrower than the width of the inner wall of the cavity. Accordingly, a portion of the inner wall in front of the resin lock remains to contact the terminal fitting and to restrict a loose movement of the terminal fitting. However, a narrow resin lock is not as strong as a wider resin lock, and an area of engagement between the narrow resin lock and the terminal fitting is small if the entire connector is small. This is thought to cause problems, such as less reliable locking function.

In view of the above, an object of the invention is to widen a lock while restricting a loose movement of a terminal fitting.

SUMMARY OF THE INVENTION

The invention is directed to a connector with a housing formed with cavities into which a corresponding number of terminal fittings can be inserted. Locks are formed to cantilever forwardly along inner walls of the cavities and are engageable with the terminal fittings to lock the terminal fittings in the cavities. A mold-removal space is formed for removing the mold that molds the locks. However, a loose movement restricting member also is provided for mounting in or on the housing and for at least partly entering the mold-removal space. More particularly, the loose movement restricting member is configured to come into contact with contact portions of the terminal fittings in front of the locking portions. Thus, the loose movement restricting member restricts loose movements of the contact portions in a direction that intersects an insertion direction of the terminal fittings.

Loose movements of the terminal fittings can be restricted by bringing the terminal fittings into contact with the loose movement restricting member fitted into the mold-removal space. Since a part separate from the housing is fitted into the mold-removal space for restricting the loose movements of the terminal fittings, the width of the mold-removal space can be set freely and the width of the locking portions can be enlarged.

The mold-removal space preferably extends from the front ends of the locks to the front end surface of the housing and substantially faces the cavities.

The housing preferably is made of a synthetic resin and the locks preferably are resin locks.

Walls of the cavities that extend along the widthwise direction of the locks may have areas cut away that correspond to the locks. As a result, the locks can be wider than normal, and at least as wide as the terminal fittings. Accordingly, the locks are stronger and the areas of engagement between the locks and the terminal fittings can be maximized.

The loose movement restricting member may be formed with at least one jig insertion space that is open at the front end surface of the housing and extends up to a molding area of the locks. A jig may be inserted into the jig insertion space to displace the lock away from the terminal fitting. Thus, locking of the terminal fitting by the lock can be canceled without removing the loose movement restricting member.

The locks preferably are resin locks that are deformed elastically or resiliently to retract from insertion paths of the terminal fittings and to enter deformation permitting spaces during insertion of the terminal fittings. The locks then are restored elastically or resiliently to be located substantially outside the deformation permitting spaces. Hence, the locks engage and lock the terminal fittings when the terminal fittings are inserted properly. The loose movement restricting member preferably comprises a detecting portion which can interfere with the resin locks projecting into the deformation permitting spaces during mounting of the loose movement restricting member into the mold-removal space.

When the terminal fittings are inserted properly and the resin locks are restored elastically, the loose movement restricting member can be mounted into the mold-removal space without any trouble, while the detecting portion is fitted into the deformation permitting space. On the other hand, if the terminal fittings are not inserted properly and the resin locks are deformed elastically to enter the deformation permitting spaces, the detecting portion interferes with the resin locks projecting into the deformation permitting spaces. Accordingly, the loose movement restricting member cannot be mounted.

The loose movement restricting member preferably comprises a deformation restricting portion that can be fit into the deformation permitting spaces when the loose movement restricting member is mounted in the mold removal space to restrict the elastic or resilient deformation of the resin locks toward the deformation permitting spaces. As a result, the resin locks can not be disengaged from the terminal fittings, and the terminal fittings are doubly locked.

The loose movement restricting member may comprise wedge-shaped restricting portions that come into contact with the terminal fittings for restricting their loose movement in the direction intersecting the insertion direction of the terminal fittings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
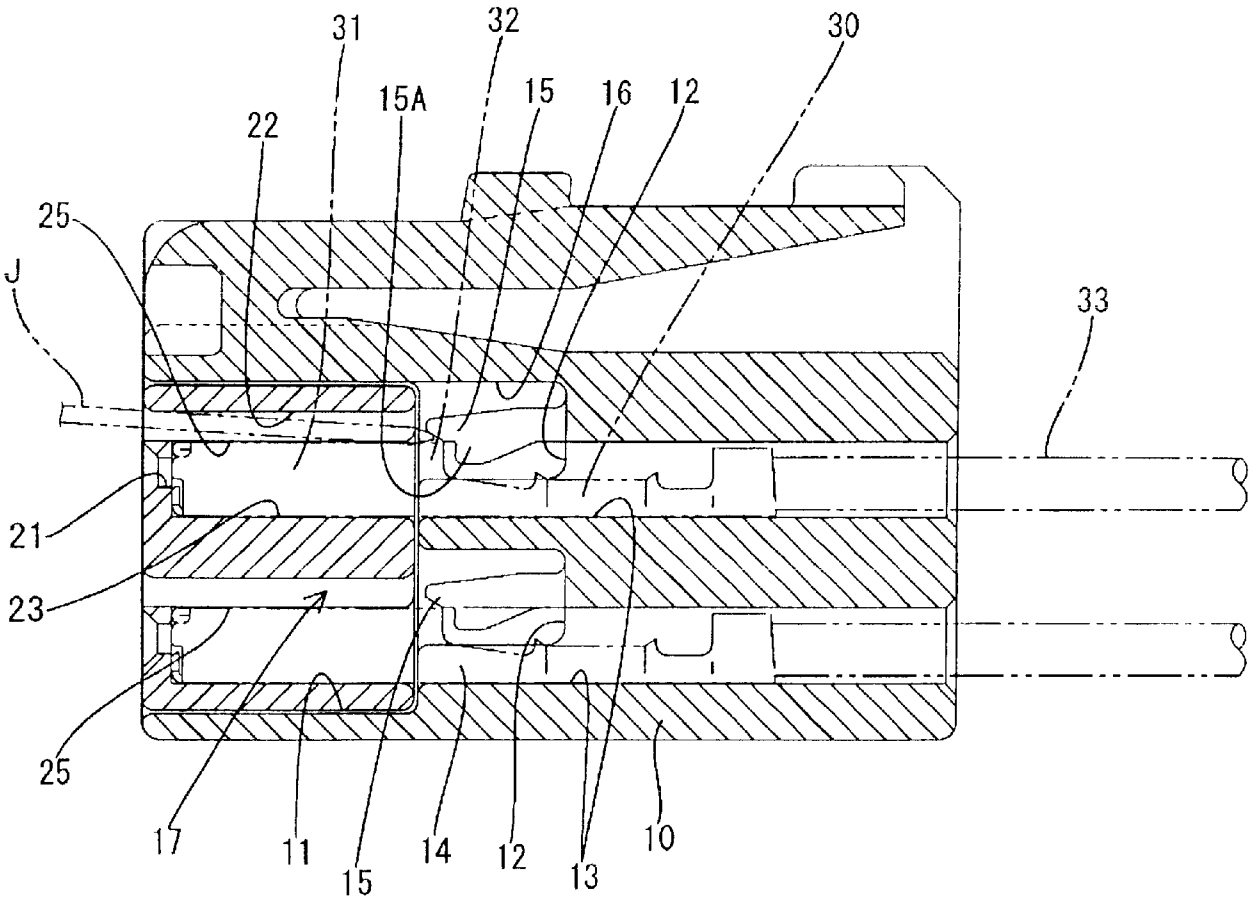
FIG. 1 is a vertical section of a first embodiment.
Figure 2:
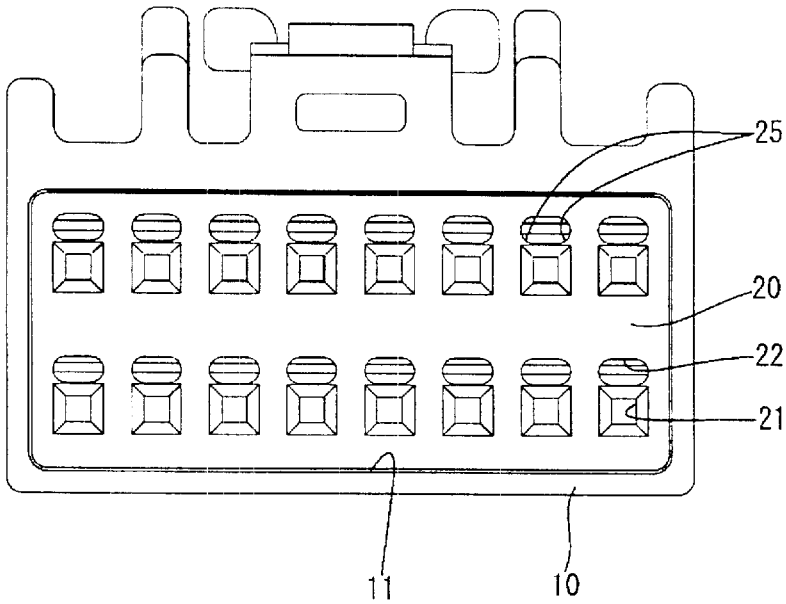
FIG. 2 is a front view of a housing with a loose movement restricting member assembled therewith.
Figure 3:
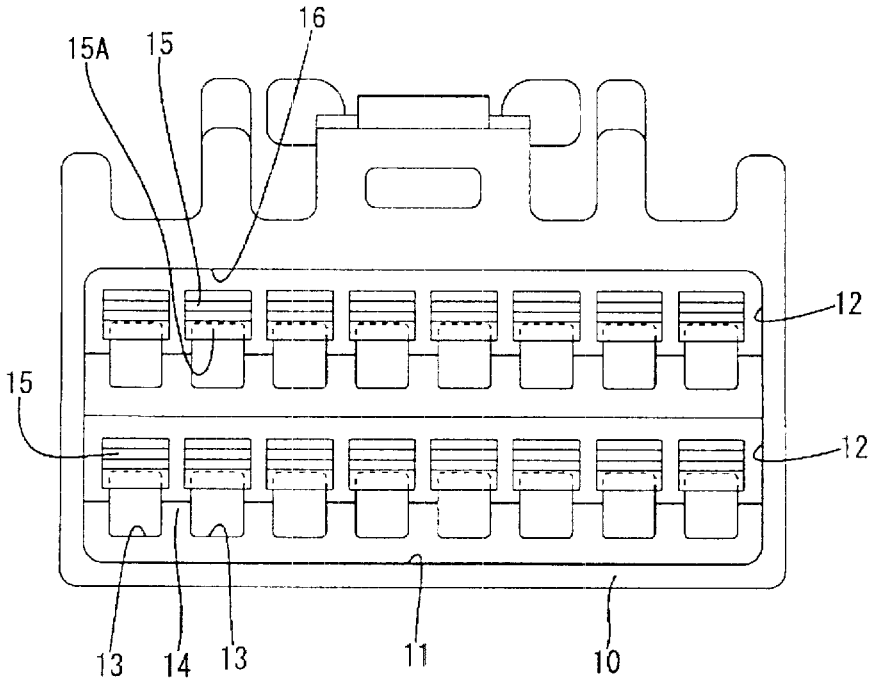
FIG. 3 is a front view of the housing with the loose movement restricting member detached therefrom.
Figure 4:
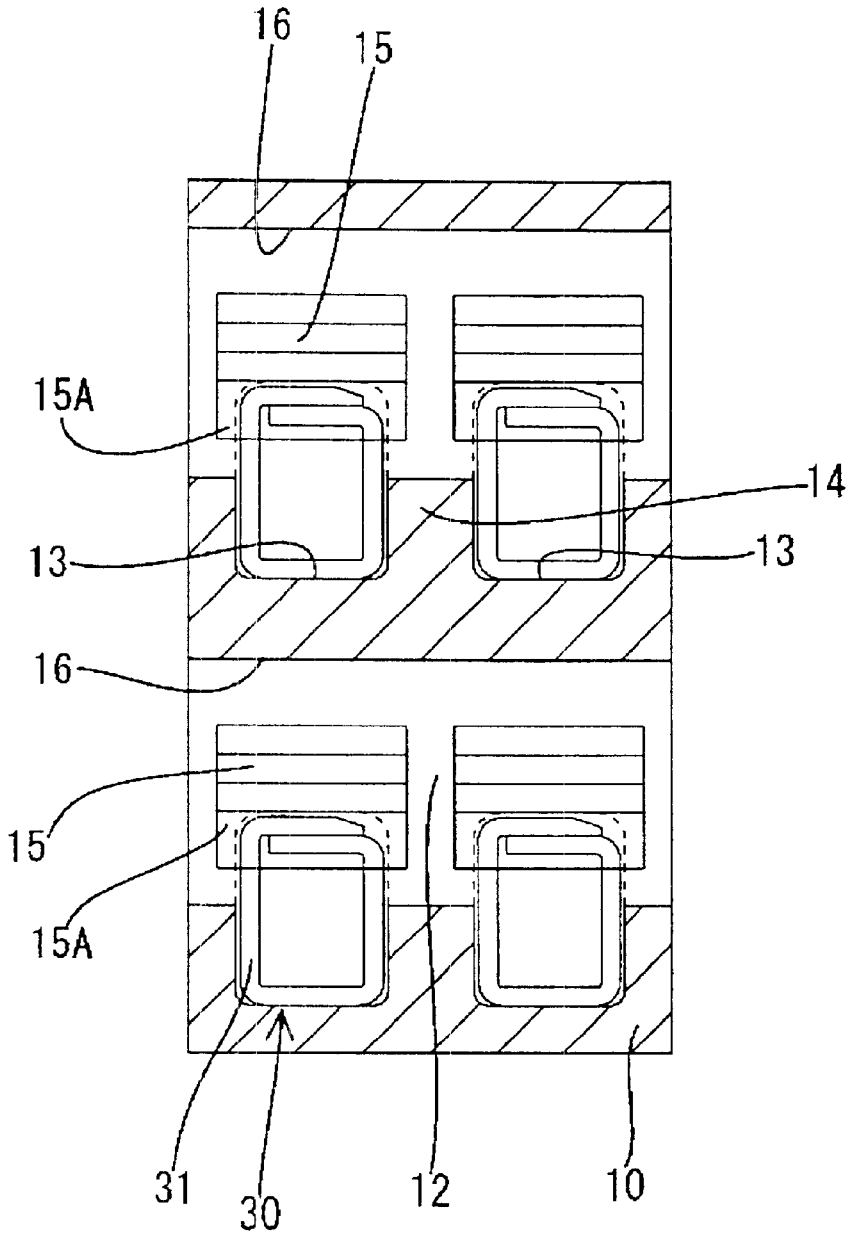
FIG. 4 is a fragmentary enlarged horizontal section showing a relationship between terminal fittings and resin locking portions.
Figure 5:
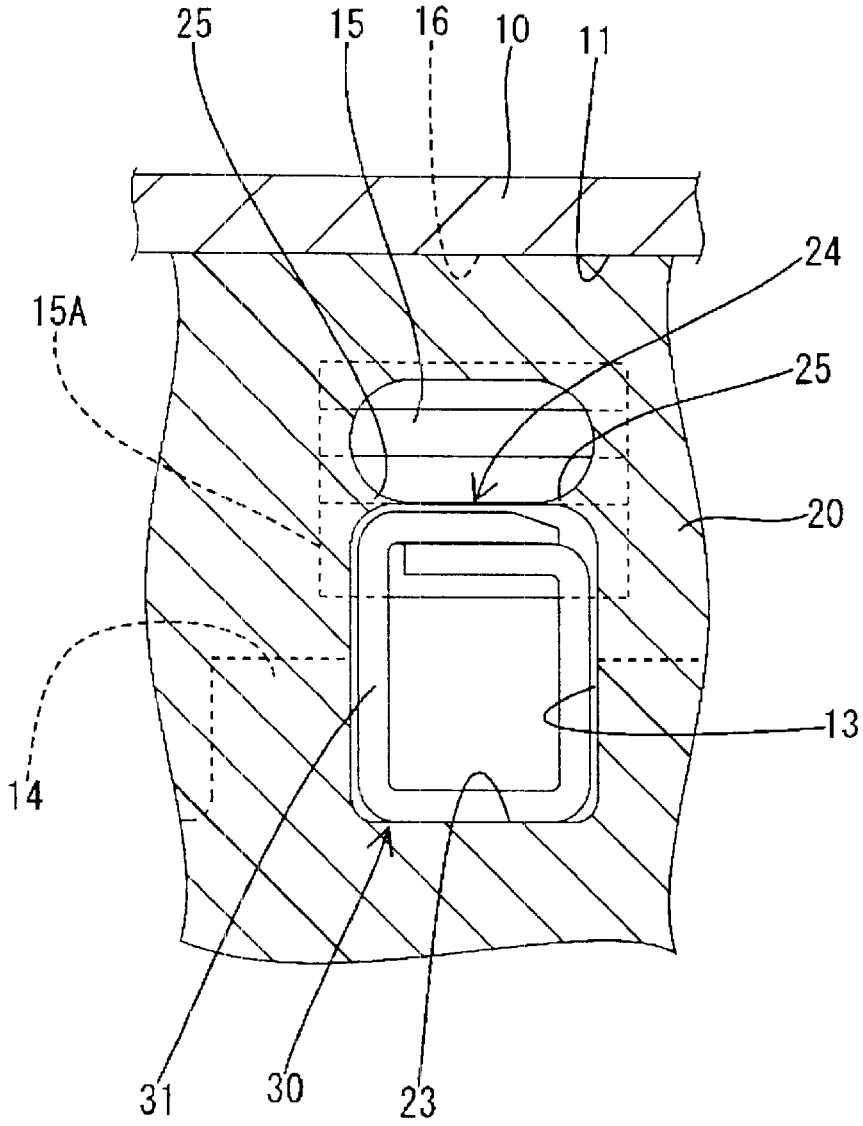
FIG. 5 is a fragmentary enlarged horizontal section showing a relationship between the loose movement restricting member and the terminal fittings.

A connector according to a first embodiment of the invention is illustrated in FIGS. 1–5, and includes a synthetic resin housing 10, a synthetic resin loose movement restricting member 20 and a plurality of electrically conductive terminal fittings 30.

Each terminal fitting 30 is formed from a metallic plate that is cut into a specified shape and bent into an elongate three-dimensional structure with opposite front and rear ends. A substantially rectangular tube 31 is formed adjacent the front end of the terminal fitting 30, and an unillustrated mating male tab can be inserted into the front end of the tube 31. A locking edge 32 is defined at the upper rear end of the rectangular tube 31, and is engageable with a resin lock 15 to be described later. The rear end of the terminal fitting 30 is connected to a wire 33, preferably by crimping.

The housing 10 includes opposite front and rear ends and substantially rectangular cavities 13 that extend longitudinally through the housing 10 between the front and rear ends. The cavities 13 are arranged substantially side by side at upper and lower stages in the housing 10. The front end of the housing 10 is formed with a first recess 11 that communicates with all of the cavities 13. Second recesses 12 are formed at the back end of the first recess 11 and correspond respectively to the rows of the cavities 13 at each of the upper and lower stages. Upper portions of the front ends of the respective cavities 13 open to the rear ends of the second recesses 12, while lower portions of the cavities 13 open to the rear ends of the first recess 11. Accordingly, partition walls 14 partition the transversely adjacent cavities 13, and have upper portions cut away at the second recesses 12.

Resin locks 15 cantilever forward from the back end surfaces of the second recesses 12 and are disposed at locations that align with the respective cavities 13. The resin locks 15 are elastically or resiliently deformable away from the cavities 13, and hence away from the insertion path of each terminal fitting 30 into the respective cavity 13. The lower surface of each resin lock 15 is substantially continuous and substantially flush with the ceiling surface of the corresponding cavity 13. However, a projection 15A is formed on the lower surface of the resin lock 15. The projection 15A normally projects below the ceiling surface of the cavity 13 and into the insertion path of the terminal fitting 30 into the cavity 13. A deformation permitting space 16 is defined between the upper surface of the resin lock 15 and the ceiling surface of the second recess 12 for permitting the resin lock 15 to be deformed. The resin lock 15 can be deformed elastically away from the insertion path in response to interference with the upper surface of the terminal fitting 30 during insertion of the terminal fitting 30.

Each resin lock 15 is wider than both the respective cavity 13 and the terminal fittings 30, and the sides of the resin locks 15 project transversely beyond both the cavities 13 and the terminal fittings 30 when viewed from front. The projections 15A of the resin locks 15 engage the locking edges 32 of the terminal fittings 30 to hold the terminal fittings 30 that have been inserted to proper insertion positions. The resin locks 15 are dimensioned longitudinally for accommodation in the second recesses 12. Accordingly, the front ends of the resin locks 15 are more backward than the back end surface of the first recess 11. Further, the upper portions of the partition walls 14 are cut away, and there is no partition between the transversely adjacent resin locks 15.

A mold-removal space 17 extends in the first recess from the front ends of the resin locks 15 to the front end surface of the housing 10. The mold-removal space 17 is formed by removing in a forward direction an unillustrated mold for molding the resin locks 15.

The loose movement restricting member 20 is closely mountable into the first recess 11 of the housing 10 such that the front end of the loose movement restricting member 20 is substantially flush with the front end surface of the housing 10. The loose movement restricting member 20 is formed with cavities 23 that correspond to and align with the respective cavities 13 of the housing 10. Thus, corresponding pairs of the cavities 13, 23 are continuous with each other so that their upper and bottom surfaces and their left and right surfaces are flush with each other. Front ends of the cavities 23 of the loose movement restricting member 20 define insertion openings 21 through which male tabs (not shown) can be inserted. However, the terminal fittings 30 are too large to pass through the insertion openings 21.

The loose movement restricting member 20 also is formed with narrow jig insertion spaces 22 that extend between the front and rear end surfaces of the loose movement restricting member 20. The jig insertion spaces 22 have a laterally oblong shape when viewed from the front, and the bottom surfaces of the jig insertion spaces 22 and the upper surfaces of the cavities 23 communicate with each other at portions 24 in FIG. 5. The communicating portions 24 are narrower than the cavities 23, and are in the widthwise middle of the cavities 23. Accordingly, the left and right ends of the upper one of the surrounding walls that form each cavity 23 serve as a pair of wedge-shaped restricting portions 25 for restricting a loose movement of the terminal fitting 30 in a direction that intersects an insertion direction of the terminal fitting 30 into the cavities 13, 23.

The loose movement restricting member 20 is mounted at least partly into the first recess 11 of the housing 10, and is held there by unillustrated locking means, such as a claw and a hole. Thus, the restricting portions 25 of the loose movement restricting member 20 enter the mold-removal space 17 in the first recess 11. In this mounted state, the cavities 13 of the housing 10 and the cavities 23 of the loose movement restricting member 20 are substantially continuous to define spaces into which the terminal fittings 30 are to be inserted.

The terminal fittings 30 then are inserted into the cavities 13, 23 from behind the housing 10. The upper front ends of the rectangular tubes 31 of the terminal fittings 30 are brought into sliding contact with the projections 15A of the resin locks 15 that project into the insertion paths of the terminal fittings 30. Thus, the resin locks 15 deflect resiliently away from the insertion path to enable a smooth insertion of the terminal fittings 30.

The rectangular tubes 31 have already passed the projections 15A when the terminal fittings 30 reach their proper insertion positions. Consequently, the resin locks 15 are restored resiliently and come out of the deformation permitting spaces 16. Thus, the projections 15A engage the locking edges 32 at the rear ends of the rectangular tubes 31 and lock the terminal fittings 30 in the respective cavities 23. In a properly inserted state, almost the entire rectangular tubes 31 are accommodated in the cavities 23 of the loose movement restricting members 20 and portions of the terminal fittings 30 behind the cavities 23 are accommodated in the cavities 13 of the housing 10.

Upper front edges of the terminal fittings 30 contact the restricting portions 25 of the loose movement restricting member 20 from behind when the terminal fittings 30 are inserted in the cavities 13, 23. Thus, external forces that would pivot the front ends of the terminal fittings 30 upward are restricted. Specifically, the loose movement restricting member 20 is inserted into the mold-removal space 17 in the first recess 11, and faces the cavities 13. Therefore, the terminal fittings 30 contact the loose movement restricting member 20. Accordingly, the width of the mold-removal space 17 facing the cavities 23 can be set freely, and, in the preferred embodiment, the width of the resin locks 15 exceeds the width of both the cavities 13, 23 and the terminal fittings 30. By enlarging the width of the resin locks 15, reliability of the locking function can be improved while ensuring an area of engagement of the resin locks 15 and the terminal fittings 30 over the entire width of the terminal fittings 30.

Upper sections of the partition walls 14 between adjacent cavities 13 are cut away so that the resin locks 15 directly face each other. Thus, it is possible to minimize spacing between the adjacent resin locks 15 and to ensure wide resin locks 15.

The loose movement restricting member 20 is open in the front end surface of the housing 10 and is formed with the jig insertion spaces 22 that extend to a molding area of the resin locks 15. The resin locks 15 can be displaced in a disengaging direction from the terminal fitting 30 by inserting a jig J into the jig insertion space. Therefore, even if the loose movement restricting member 20 is not detached from the housing 10, the terminal fittings 30 can be disengaged from the corresponding resin locks 15 and withdrawn from the cavities 13, 23.

Figure 6:
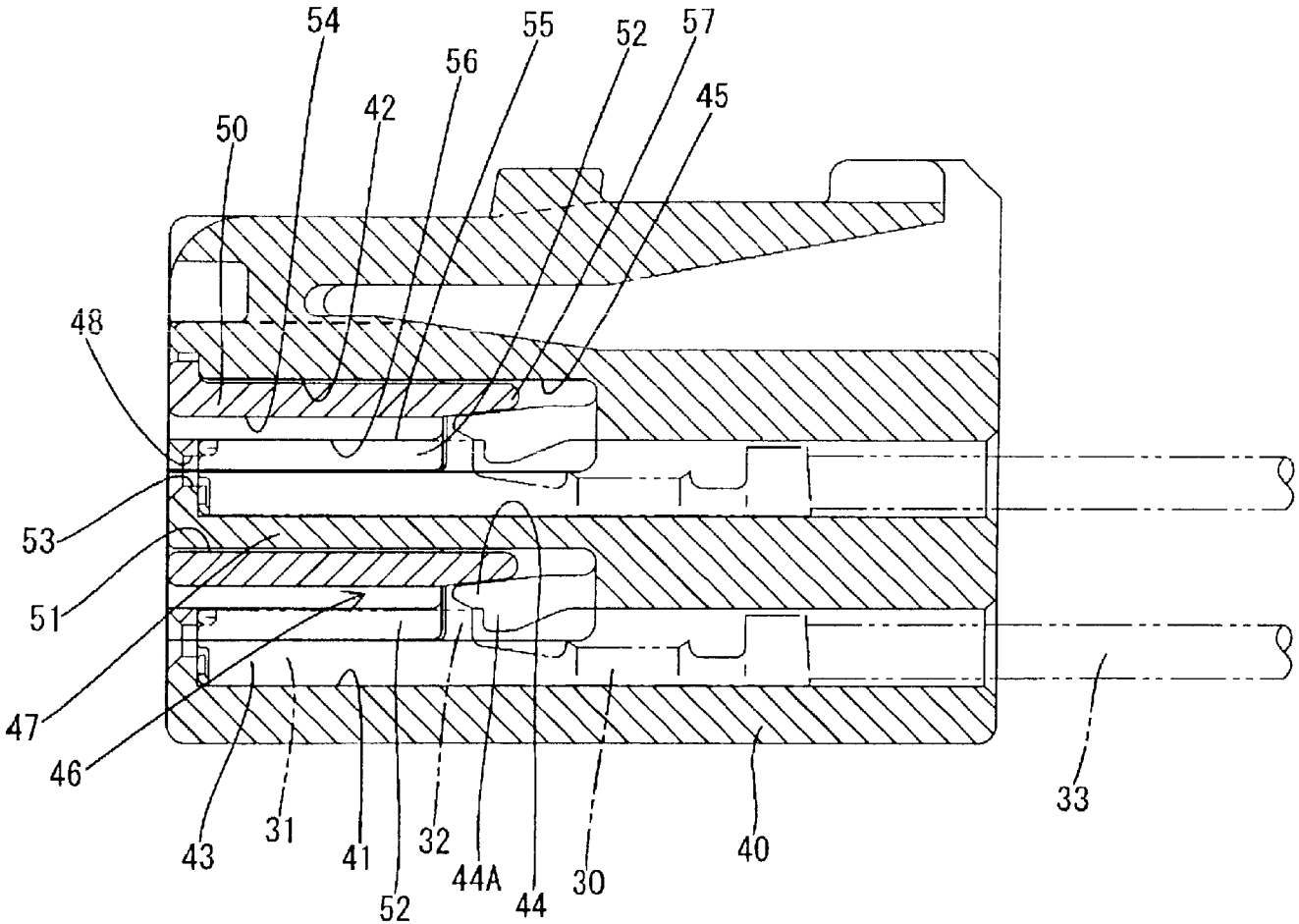
FIG. 6 is a vertical section of a second embodiment with a loose movement restricting member assembled with a housing.
Figure 7:
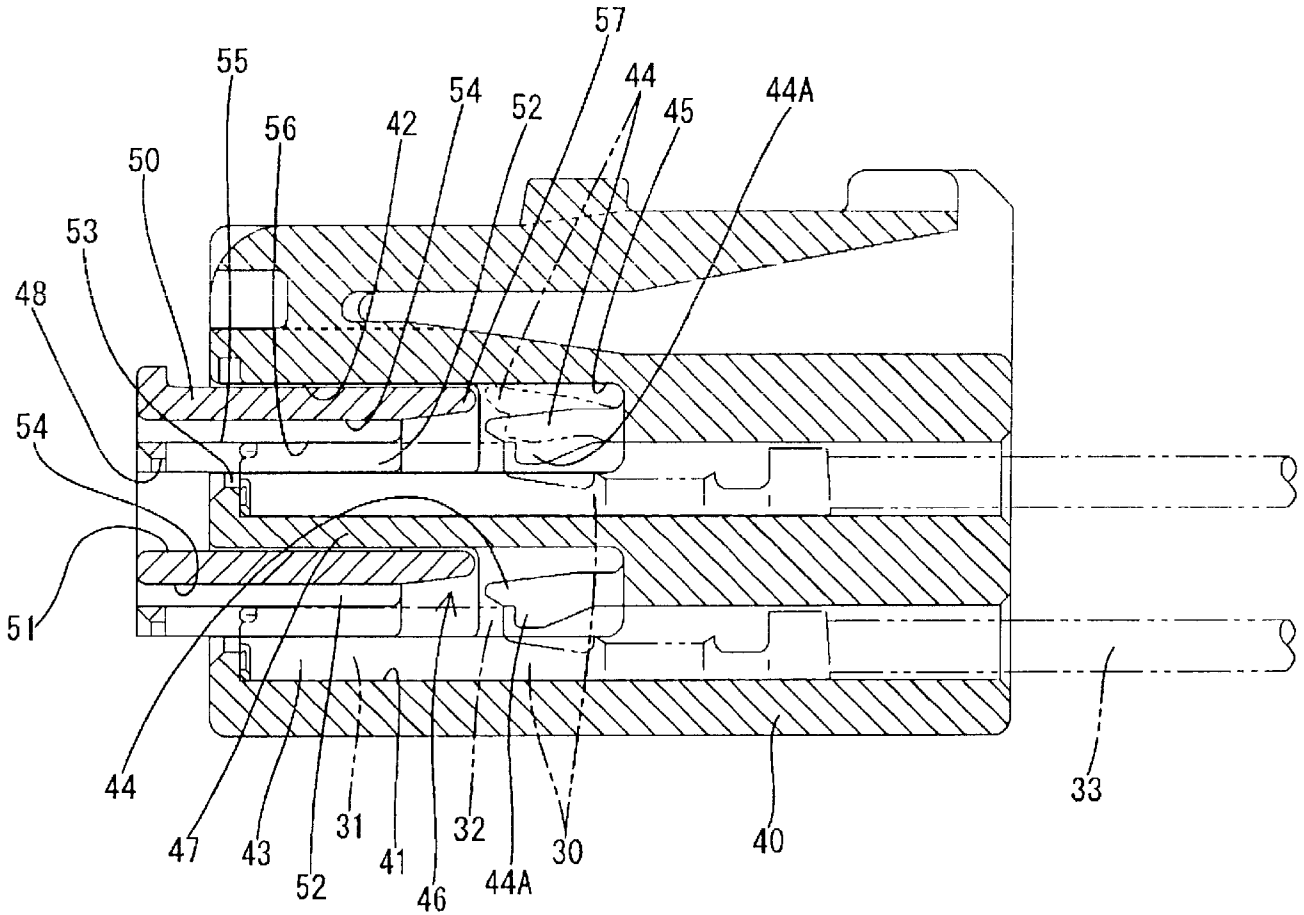
FIG. 7 is a vertical section of the second embodiment in an intermediate state of assembling of the loose movement restricting member.

A connector according to a second embodiment is illustrated in FIGS. 6 and 7, and comprises a housing 40 made of a synthetic resin, a loose movement restricting member 50 made of a synthetic resin, and a plurality of electrically conductive terminal fittings 30. The terminal fittings 30 are the same as or similar to those of the first embodiment, and hence, they merely are identified by the same reference numerals without a detailed description.

Substantially rectangular cavities 41 extend longitudinally through the housing 40, and are arranged substantially side by side at upper and lower stages. Upper and lower recesses 42 are recessed into the front end surface of the housing 40 and correspond respectively to the upper and lower stages of the cavities 41. Each recess 42 communicates with the upper surfaces of substantially front halves of the respective cavities 41 at the corresponding stage. Partition walls 43 partition the cavities 41 along transverse directions, but have upper front portions cut away by the recesses 42.

Resin locks 44 are provided for each cavity 41 and cantilever forward from the back end surfaces of the second recesses 12. The resin locks 44 are vertically elastically or resiliently deformable. A deformation permitting space 45 is defined between the upper surface of the resin lock 44 and the ceiling surface of the recess 42 for permitting the resin lock 44 to be deformed elastically or resiliently away from the insertion path of the terminal fitting 30 into the cavity 13. The lower surface of each resin lock 44 is continuous and flush with the ceiling surface of the corresponding cavity 41. However, a projection 44A is formed on the lower surface of the resin lock 44 and normally projects into the insertion path of the terminal fitting 30 into the cavity 41. Accordingly, the resin lock 44 interferes with the upper surface of the terminal fitting 30 during the insertion of the terminal fitting 30 into the cavity 13. As a result, the resin lock 44 deforms into the deformation permitting space 45 sufficiently for the projection 44A to retract from the insertion path of the terminal fitting 30. The resin lock 44 resiliently returns toward an undeflected condition after sufficient insertion of the terminal fitting 30 into the cavity 13, and the projection 44A engages the locking edge 32 of the corresponding terminal fitting 30 from behind to lock the terminal fitting 30 in the cavity 13. In this locked state, the resin lock 44 is substantially outside the deformation permitting space 45. Furthermore, if the resin lock 44 is deformed elastically to project into the deformation permitting space 45, the projection 44A is disengaged from the terminal fitting 30, and the locked state of the terminal fitting 30 by the resin lock 44 is cancelled.

Although not shown, the resin locks 44 are wider than both the cavities 41 and the terminal fittings 30 as in the first embodiment, and the left and right ends of the resin locks 44 project transversely from the cavities 41 and the terminal fittings 30 when viewed from the front. The length of the resin locks 44 is set so that the rear end surface of the loose movement restricting member 50 does not interfere with the resin locks 44 even when the loose movement restricting member 50 is fitted in the recess 42. Further, since upper portions of the partition walls 43 between the adjacent cavities 41 are cut away, there is nothing between the transversely adjacent resin locks 44.

A mold-removal space 46 is defined in the recesses 42 before the respective resin locks 44, and enables removal of an unillustrated mold for molding the resin locks 44. The mold-removal space 46 extends from the front ends of the resin locks 44 to the front end surface of the housing 40.

The loose movement restricting member 50 is fit closely in the recesses 42 of the housing 40, and includes an escape space 51 for avoiding interference with a lower wall 47 of the upper stage cavities 41. Terminal accommodating grooves 52 extend longitudinally along the loose movement restricting member 50 and face lower front portions of the respective cavities 41. The terminal accommodating grooves 52 and the cavities 41 define substantially equal widths and register with one another when the loose movement restricting member 50 is mounted in the housing 40. Thus, accommodation spaces for the terminal fittings 30 are defined between the terminal accommodating grooves 52 and the opposed cavities 41. Registered notches 48 and 53 are formed at the front ends of the cavities 41 and the terminal accommodating grooves 52. The notches 48 and 53 define insertion openings for male tabs. However, the terminal fittings 30 are too large to pass through the insertion openings.

Narrow jig insertion spaces 54 are bored through the loose movement restricting member 50 between its front and rear end surfaces. As in the first embodiment, the jig insertion spaces 54 have a laterally oblong shape when viewed from front. Bottom surfaces of the jig insertion spaces 54 and upper surfaces of the cavities 23 communicate with each other at communicating portions 55. The communicating portions 55 are narrower than both the terminal accommodating grooves 52 and the cavities 41, and are centrally disposed along the widths of the terminal accommodating grooves 52 and the cavities 41, as in the first embodiment. Accordingly, the left and right sides of the upper walls of each terminal accommodating groove 52 define restricting portions 56 for restricting a loose upward movement of the terminal fitting 30.

The loose movement restricting member 50 is formed with a projecting portion 57 that cantilevers backward towards the resin locks 44. The projecting portion 57 does not interfere with the resin locks 44 during mounting of the loose movement restricting member 50 into the recesses 42 (mold-removal space 46) of the housing 40, if the resin locks 44 are outside the deformation permitting spaces 45. However, the projecting portion 57 performs a detecting function by interfering with any resin locks 44 that are in the deformation permitting spaces 45. The projecting portion 57 permits the elastic deformation of the resin locks 44 toward the deformation permitting spaces 45 when the loose movement restricting member 50 is not fitted in the recesses 42. However, the projecting portion 57 fits into the deformation permitting spaces 45 when the loose movement restricting member 50 is mounted in the mold-removal space 46 to prevent deformation of the resin locks 44.

The connector according to this embodiment is assembled by first mounting the loose movement restricting member 50 into the recesses 42 of the housing 40. The housing 40 and the loose movement restricting member 50 are locked into each other by an unillustrated locking means, such as a claw and a hole. The restricting portions 56 of the loose movement restricting member 50 enter the mold-removal space 46 in the recesses 42 during the mounting of the loose movement restricting member 50 into the housing 40. Spaces for accommodating the front end portions of the terminal fittings 30 are defined by the cavities 41 of the housing 40 and the terminal accommodating grooves 52 of the loose movement restricting member 50 after the loose movement restricting member 50 is mounted in the housing 40.

Assembly proceeds by inserting the terminal fittings 30 into the cavities 41 from behind the housing 40. The front ends of the upper surfaces of the rectangular tubes 31 of the terminal fittings 30 interfere with the projections 44A of the resin locks 44 that project into the insertion paths of the terminal fittings 30. As a result, the upper surfaces of the rectangular tubes 31 of the terminal fittings 30 are brought into sliding contact with the projections 44A and cause the resin locks 44 to deform elastically or resiliently out of the insertion path. When the terminal fittings 30 reach their proper insertion positions, the resin locks 44 resiliently return toward their original positions outside the deformation permitting spaces 45 and engage the locking edges 32 at the rear ends of the rectangular tubes 31 to lock the terminal fittings 30 in the cavities 41.

The projecting portion 57 is fit in the deformation permitting spaces 45 when the loose movement restricting member 50 is mounted fully in the housing 40. Thus, the elastic deformation of the resin locks 44 toward the deformation permitting spaces 45 and disengagement of the projections 44A of the resin locks 44 from the locking edges 32 of the terminal fittings 30 is restricted. As a result, the terminal fittings 30 are locked doubly by direct locking of the resin locks 44 and restriction on the disengagement of the resin locks 44 by the projecting portion 57.

Proper mounting of the terminal fittings 30 enables the resin locks 44 to be restored resiliently when the loose movement restricting member 50 is to be mounted. Thus, the loose movement restricting member 50 can be mounted into the mold-removal space 46 without trouble while the projecting portion 57 is fit into the deformation permitting spaces 45, as described above. On the other hand, if the terminal fittings 30 are not inserted properly, the projections 44A contact the upper surfaces of the rectangular tubes 31, and the resin locks 44 remain in the deformation permitting spaces 45. Thus, the projecting portion 57 interferes with the resin locks 44 in the deformation permitting spaces 45, and further mounting of the loose movement restricting member 50 is not possible. Thus, whether the terminal fittings 30 are inserted properly can be detected based on whether or not the loose movement restricting member 50 can be mounted into the housing 40.

No description is given on the function of restricting the loose upward movements of the terminal fittings 30 by the loose movement restricting member 50, the structure, function and effect of making the resin locking portions 44 wider than the terminal fittings 30, and the function and effect of forming the jig insertion spaces 54 in the loose movement restricting member 50 since they are the same or similar as in the first embodiment.

The present invention is not limited to the above described and illustrated embodiments. For example, following embodiments are also embraced by the technical scope of the present invention as defined in the claims. Beside the following embodiments, various changes can be made without departing from the scope and spirit of the present invention as defined in the claims.

The present invention is applied to the connector in which female terminal fittings are inserted into the housing in the foregoing embodiments. However, it is also applicable to connectors in which male tabs are inserted into a housing.

The resin locks are wider than the cavities in the foregoing embodiments. However, the resin locks may be equal to or narrower than the cavities according to the present invention.

Although the loose movement restricting member surrounds the terminal fittings over their entire circumferences in the foregoing embodiments, the inner walls where no mold-removal space is defined may be formed integral to the housing and the loose movement restricting member may be fitted only in the mold-removal space according to the present invention.

Although the partition walls between the cavities adjacent along the same direction as the widthwise direction of the resin locks have their areas corresponding to the resin locks cut away in the foregoing embodiments, the adjacent resin locks may be partitioned by partition walls without providing such cut-away portions according to the present invention.

What is claimed is:

1. A connector, comprising:

a housing with opposite front and rear ends and a plurality of cavities extending between the ends for receiving a corresponding plurality of terminal fittings, the housing further including at least one partition wall between the cavities, locks cantilevered forward along inner walls of the cavities and being engageable with the terminal fittings to lock the terminal fittings in the cavities, said partition wall having an opening substantially aligned with the locks, and the locks being at least as wide as the terminal fittings at locations where the locks align with the opening in the partition wall and at locations where the locks engage the terminal fittings, a mold-removal space formed between the locks and the front end of the housing, and a loose movement restricting member mountable in the mold-removable space of the housing for contacting sides of the terminal fittings between the locks and the front end of the housing to restrict loose movements of the terminal fittings in a direction intersecting an insertion direction of the terminal fittings.

2. A connector according to claim 1, wherein the mold-removal space faces into the cavities.

3. A connector according to claim 1, wherein the housing is made of a synthetic resin and wherein the locks are resin locks.

4. A connector according to claim 1, wherein the loose movement restricting member has at least one jig insertion space which is open at the front of the housing and extends to the locks.

5. A connector according to claim 1, further comprising deformation-permitting spaces on sides of the locks opposite the cavities, the locks being resiliently deformed to retract from insertion paths of the terminal fittings and into the deformation permitting spaces during insertion of the terminal fittings and being resiliently restored to be located substantially outside the deformation permitting spaces for engaging the terminal fittings when the terminal fittings are properly inserted.

6. A connector according to claim 5, wherein the loose movement restricting member comprises a detecting portion configured to interfere with the locks projecting into the deformation permitting spaces for preventing mounting of the loose movement restricting member into the mold-removal space.

7. A connector according to claim 5, wherein the loose movement restricting member comprises a deformation restricting portion which fits in the deformation permitting spaces for restricting resilient deformation of the locks toward the deformation permitting spaces when the loose movement restricting member is mounted in the mold-removal space.

8. A connector according to claim 5, wherein the loose movement restricting member comprises at least one wedge-shaped restricting portion disposed for contacting and restricting loose movement of the terminal fittings in at least one direction intersecting the insertion direction of the terminal fittings.

9. A connector, comprising:

a housing with opposite front and rear ends and a plurality of transversely adjacent cavities extending between the ends, each said cavity being formed partly by two opposed side walls defining a width for the respective cavity, each said side wall having an opening extending transversely of the respective cavities;

resiliently deflectable locks cantilevered forward along portions of the cavities and extending into the openings in the respective side walls, such that the locks are wider than the respective cavities, each said lock having a projection extending into the respective cavity in an undeflected condition of the lock;

a mold-removal space formed between the locks and the front end of the housing; and a loose movement restricting member mountable in the mold-removable space of the housing and adjacent the respective cavities, whereby the loose movement restricting member is configured for engaging and preventing loose movement of a terminal fitting inserted into the cavity.

10. The connector of claim 9, further comprising deflection permitting spaces formed in the housing on a side of each said lock opposite the respective cavity for accommodating deflection of the respective lock away from the cavity.

11. The connector of claim 10, wherein the loose movement restricting member comprises a deflection preventing portion extending into the deflection permitting spaces for preventing deflection of the locks.

12. The connector of claim 9, wherein the housing and the locks are unitarily molded from a resin material.

* * * * *